US009717338B2

(12) United States Patent
Barnett

(10) Patent No.: US 9,717,338 B2
(45) Date of Patent: Aug. 1, 2017

(54) ANTI-TIP ROLLER

(71) Applicant: Ralph Lipsey Barnett, Wilmette, IL (US)

(72) Inventor: Ralph Lipsey Barnett, Wilmette, IL (US)

( * ) Notice: Subject to any disclaimer, the term of this patent is extended or adjusted under 35 U.S.C. 154(b) by 0 days.

(21) Appl. No.: 14/480,100

(22) Filed: Sep. 8, 2014

(65) Prior Publication Data

US 2015/0132097 A1 May 14, 2015

Related U.S. Application Data

(60) Provisional application No. 61/874,504, filed on Sep. 6, 2013.

(51) Int. Cl.

| | |
|---|---|
| ***A47B 91/00*** | (2006.01) |
| ***A47B 97/00*** | (2006.01) |
| *A47B 63/00* | (2006.01) |

(52) U.S. Cl.

CPC ..... *A47B 97/00* (2013.01); *A47B 63/00* (2013.01); *A47B 2097/008* (2013.01)

(58) Field of Classification Search

CPC ..... A47B 2097/008
USPC ..... 312/249.8, 249.11, 351.11–351.13
See application file for complete search history.

(56) References Cited

U.S. PATENT DOCUMENTS

| | | | | | |
|---|---|---|---|---|---|
| 2,156,776 | A * | 5/1939 | Drover | A47B 17/036 | 108/80 |
| 3,482,894 | A * | 12/1969 | Pryor | A47B 91/024 | 280/47.35 |
| 3,535,010 | A * | 10/1970 | Eff | A47B 77/12 | 180/15 |
| 3,750,593 | A * | 8/1973 | Zetterlund | B61B 10/04 | 104/172.2 |
| 4,208,818 | A * | 6/1980 | Butcher | 40/650 | |
| 5,046,790 | A * | 9/1991 | Onomoto et al. | 312/351.13 | |
| 5,549,375 | A * | 8/1996 | Pagliaccio | A47B 88/0451 | 312/223.2 |
| 5,590,938 | A * | 1/1997 | De Andrea | H05K 7/1429 | 312/236 |
| 5,711,162 | A * | 1/1998 | Wolanin et al. | 62/302 | |
| 5,738,423 | A * | 4/1998 | Alfaro | 312/290 | |
| 5,779,067 | A * | 7/1998 | Reaney | A47B 88/0411 | 211/134 |
| 6,050,660 | A * | 4/2000 | Gurley | 312/249.1 | |
| 6,663,074 | B2 * | 12/2003 | Prior | 248/461 | |
| 7,766,161 | B2 * | 8/2010 | Good | 206/349 | |

* cited by examiner

*Primary Examiner* — Matthew Ing
(74) *Attorney, Agent, or Firm* — Pauley Erickson & Kottis

(57) ABSTRACT

A file cabinet with a roller positioned on the bottom of the cabinet in proximity to a front edge of the cabinet to prevent the cabinet from tipping over when acted on by a force generally perpendicular to the front edge. The roller also provides a method of moving the file cabinet by rolling the file cabinet.

19 Claims, 7 Drawing Sheets

ANTI-TIP ROLLER

CROSS REFERENCE TO RELATED APPLICATION

This application claims the benefit of U.S. Provisional Patent Application, Ser. No. 61/874,504, filed on 6 Sep. 2013. The co-pending Provisional Patent Application is hereby incorporated by reference herein in its entirety and is made a part hereof, including but not limited to those portions which specifically appear hereinafter.

BACKGROUND OF THE INVENTION

Field of the Invention

This invention is directed to a device to prevent file cabinets, furniture and other large items from tipping over and possibly injuring individuals. More specifically, this invention is directed to a roller attached to a front edge of a file cabinet to allow the file cabinet to traverse or slide forward rather than tip over.

Discussion of Related Art

File cabinets can be a tipping danger. The danger can be increased under reasonably foreseeable circumstances including: overloading of extended drawers; pulling downward on extended drawers; pulling horizontally on open or closed drawer hardware or cabinet structure; becoming ensnared on the cabinet structure while walking away from the unit; impacting or pushing forward on a backside of the cabinet by people or vehicles, such as forklifts; mounting cabinets on non-level surfaces; and impact from rapidly opening drawers against stops. Known methods and devices for increasing the stability of the file cabinets include: bolting the cabinets to the floor and/or wall; adding counterweights; gang bolting cabinets side-to-side or back-to-back; locating the file cabinet beneath a shelf or other horizontal surface that blocks the cabinet's ability to tilt; and interlock systems that permit only one drawer to be open at a time. Bolting, ganging and under mounting work well to minimize tipping, however, these methods immobilize cabinets and inhibit relocation within an office or other space. Counterweights and interlocks only provide modest improvement in overturning resistance and cannot be retrofit to traditional file cabinets that have multi-decade life spans.

SUMMARY OF THE INVENTION

A general object of the invention is to allow a file cabinet to translate forward, rather than tip over, when acted on by a horizontal force. Another object of this invention is to improve the movability of the file cabinet.

When solid objects are freestanding on a plane surface, horizontal forces can translate, rotate, or leave the objects unaffected. These events are mutually exclusive and jointly exhaustive, that is, one and only one will occur. To minimize or eliminate the dangerous rotation or tip-over of a file cabinet, the file cabinet of this invention includes a roller on a lower front edge of the cabinet. When a forward acting load causes the lower rear edge of the cabinet to lift-off or drag along the surface, the entire file cabinet of this invention will translate forward without tipping over. The front lower edge rides along the surface on the roller. The file cabinet, when pulled, impacted, or pushed forward may rock fore and aft while moving frontward, but will not tip-over when snagged, pulled, or pushed. As a precaution, the file cabinet should not be overloaded as loaded cabinet drawers may negate safety benefits of the file cabinet roller of this invention.

In a preferred embodiment of this invention, the cabinet includes a housing with a plurality of drawers. The file cabinet further includes the roller connected to the housing and projecting from a bottom surface of the housing in proximity to a front edge, where the front is a side of the file cabinet that the drawers extend from. The roller preferably projects slightly from the lower surface of the file cabinet, the projection preferably ranges from ¼ inch to ½ inch however any projection which allows the file cabinet to translate forward rather than tip over may be used.

BRIEF DESCRIPTION OF THE DRAWINGS

These and other objects and features of this invention will be better understood from the following detailed description taken in conjunction with the drawings, wherein.

DETAILED DESCRIPTION OF PREFERRED EMBODIMENTS

Figure 1A:
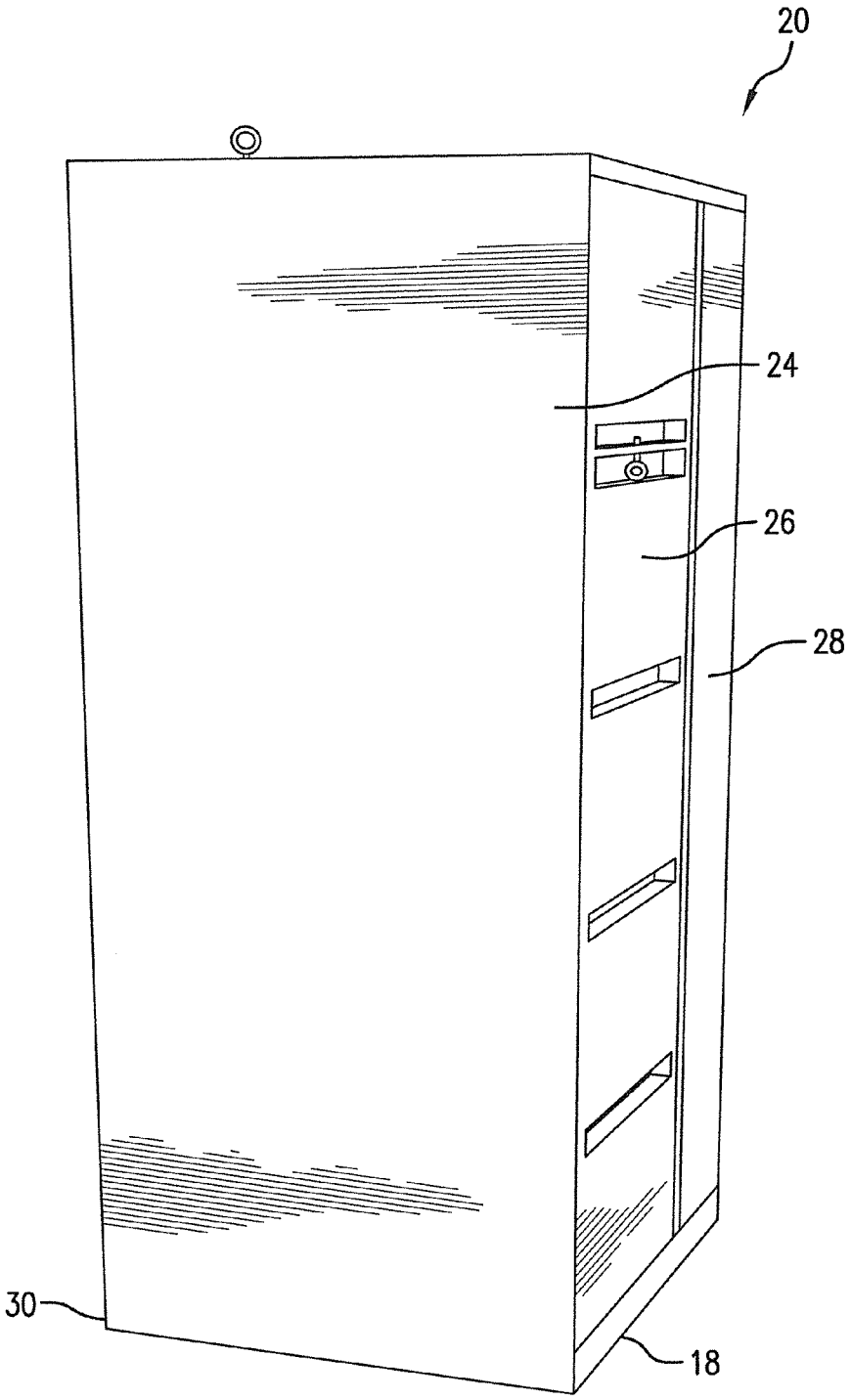
FIG. 1*a* is a perspective view of a file cabinet with a roller according to an embodiment of this invention.
Figure 1B:
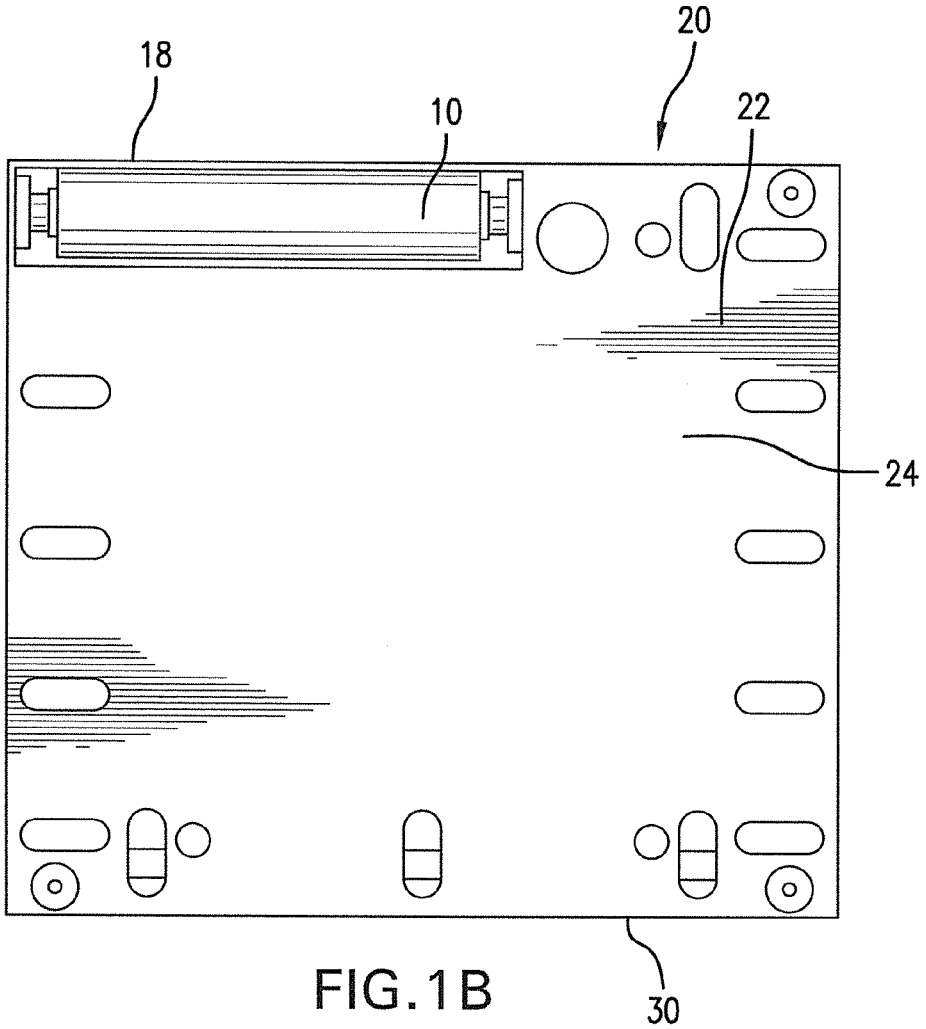
FIG. 1*b* is a bottom view of the file cabinet of FIG. 1*a*.
Figure 1C:
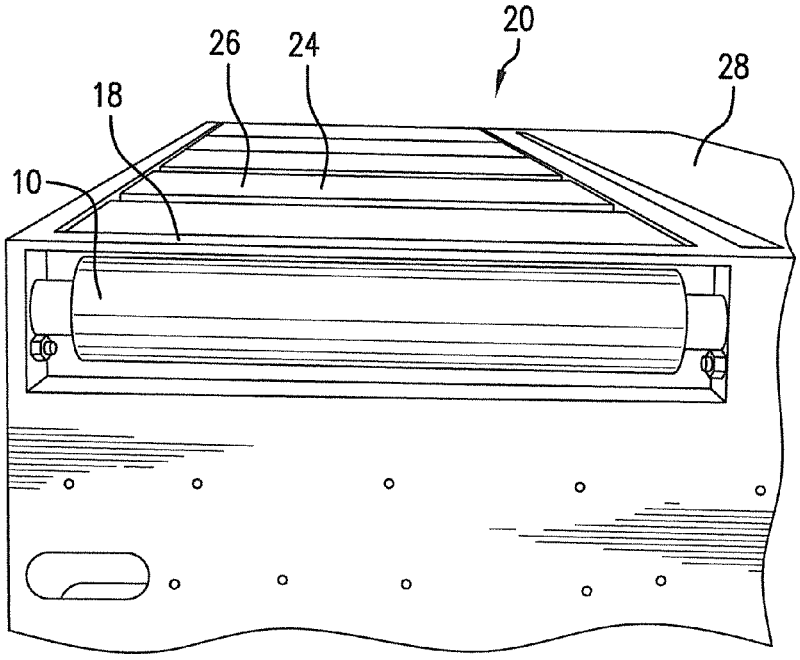
FIG. 1*c* is an enlarged view of the roller in FIG. 1*b*.

The present invention is directed to a file cabinet 20 with a roller 10 connected to and projecting from a bottom surface 22 of the filed cabinet 20 to prevent the file cabinet 20 from tipping over and possibly causing injuries. In an alternative embodiment, the roller of this invention may be incorporated into any type of furniture, appliance, or large object that may be prone to tipping over including, but not limited to, bookcases, televisions, and dressers.

FIGS. 1*a*-1*d* show an embodiment of the file cabinet 20 of this invention. The file cabinet 20 includes a housing 24 with a plurality of horizontal pull drawers 26 and a wardrobe door 28. In this embodiment, the file cabinet includes five drawers 26 and one wardrobe door 28. However, the file cabinet 24 may include any number of drawers 26 and with or without the wardrobe door 28. In a preferred embodiment, the file cabinet 20 is made of a strong and durable material capable of supporting heavy loads, for example but not limited to, steel and aluminum.

Figure 1D:
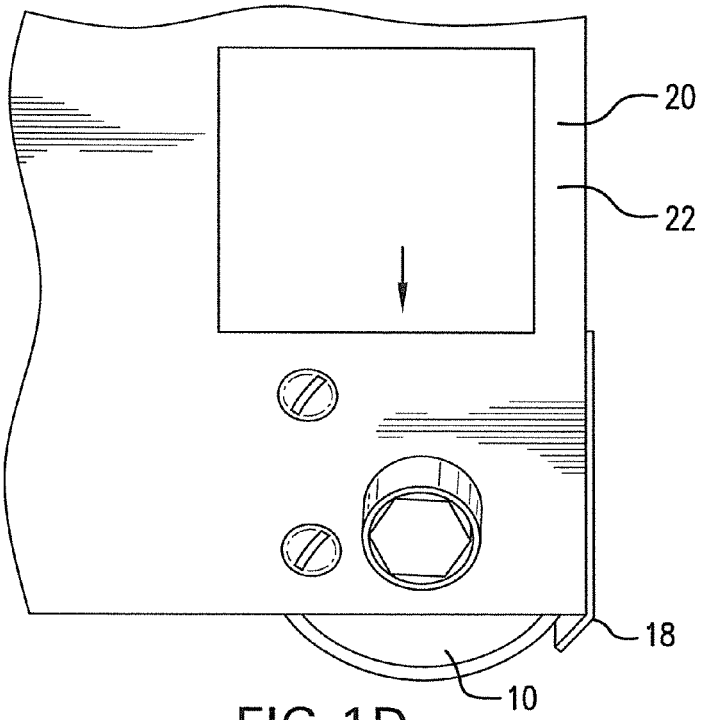
FIG. 1*d* is an enlarged side view of the roller in FIG. 1*b*.

In the embodiment of FIGS. 1*a*-1*d*, the roller 10 is a single roller unit mounted to the housing 24 and extending partially across and in proximity to a front edge 18 of the bottom surface 22, where a front of the cabinet is a surface from which the drawers 26 extend. In an alternative embodiment, the roller 10 extends across the entire length of the bottom surface 22. In another alternative embodiment, the roller 10 comprises a plurality of wheels or roller units. In a preferred embodiment, the roller 10 includes a bearing and/or a lubricating substance, such as oil or graphite, to reduce friction on the roller 10. As best shown in FIG. 1*d*, the roller 10 projects ¼ inch from the lower surface 22. In an alternative embodiment, the roller 10 may project any height from the lower surface 22 including for example, from 1/16 inch to 1 inch or more. In an embodiment of this invention, the roller 10 may be selectable to only roll in one direction. For example, to prevent the cabinet from tipping over, the roller 10 may only roll forward and to use the cabinet 20 in a wheelbarrow mode the roller may only roll backwards.

Figure 2:
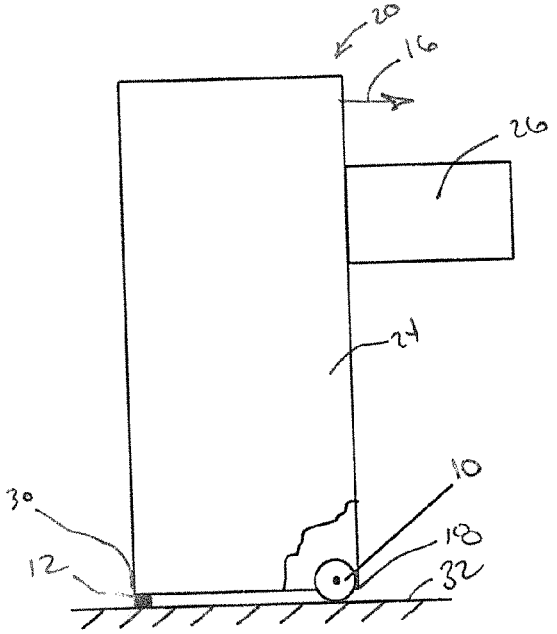
FIG. 2 is a schematic view of the file cabinet and roller according to an embodiment of this invention.

FIG. 2 shows a schematic representation of the cabinet 20 and roller 10 of this invention. The roller 10 is connected to the housing 24 in proximity to the front edge 18 of the cabinet 20, where the front is defined as a surface of the housing from which the drawers 26 extend. The roller 10 also projects from the bottom surface 22 of the cabinet 20. In this embodiment, a leveling screw 12 is positioned on the bottom surface 22 in proximity to the rear edge 30 of the housing 24 opposite to the front edge 18. Preferably, the leveling screw 12 compensates for the projection of the roller 10 to keep the cabinet 20 level.

In operation, when a forward acting load 16 causes the lower rear edge 30 of the cabinet 20 to lift-off or drag along a surface 32, the file cabinet 20 will translate forward on the roller 10 without tipping. The front lower edge 18 will ride along the surface 32 on the roller 10. The file cabinet 20, when pulled, impacted, or pushed forward may rock fore and aft while moving frontward however the cabinet 20 will not tip over. As a precaution, the file cabinet 20 of this invention should not be overloaded, as the loaded cabinet drawers may negate safety benefits of the file cabinet roller of this invention.

Figure 3:
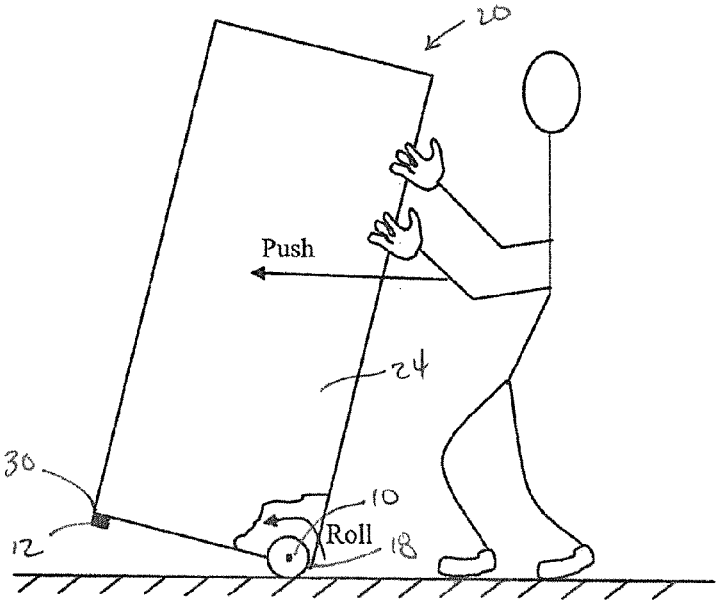
FIG. 3 is a schematic view of the file cabinet pf FIG. 3 showing a wheelbarrow mode.

FIG. 3 shows a schematic illustrating another mode of operation of this invention. As shown in FIG. 3, the file cabinet 20 may be tipped and supported by an individual who may then move the file cabinet 20 by rolling the cabinet 20 on the roller 10.

Figure 4:
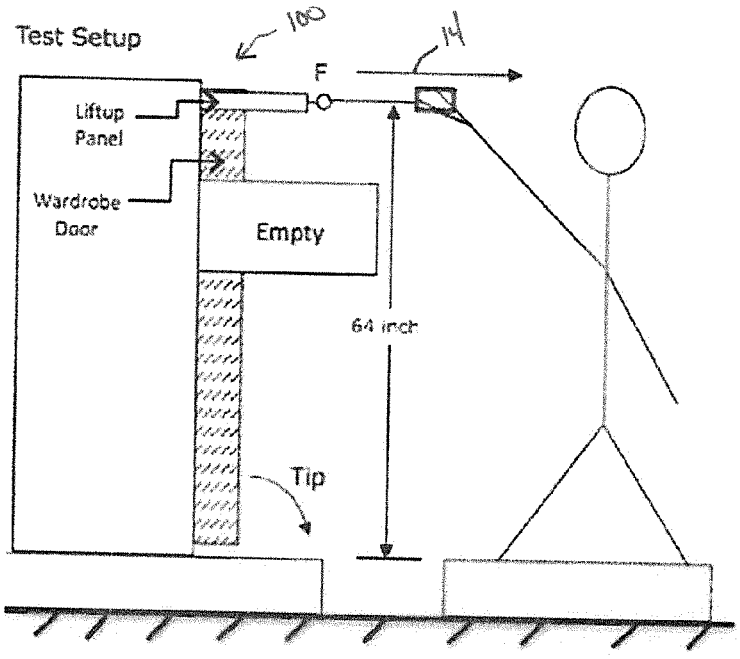
FIG. 4 is a schematic view of a test set up for a prior art file cabinet without the roller.
Figure 5:
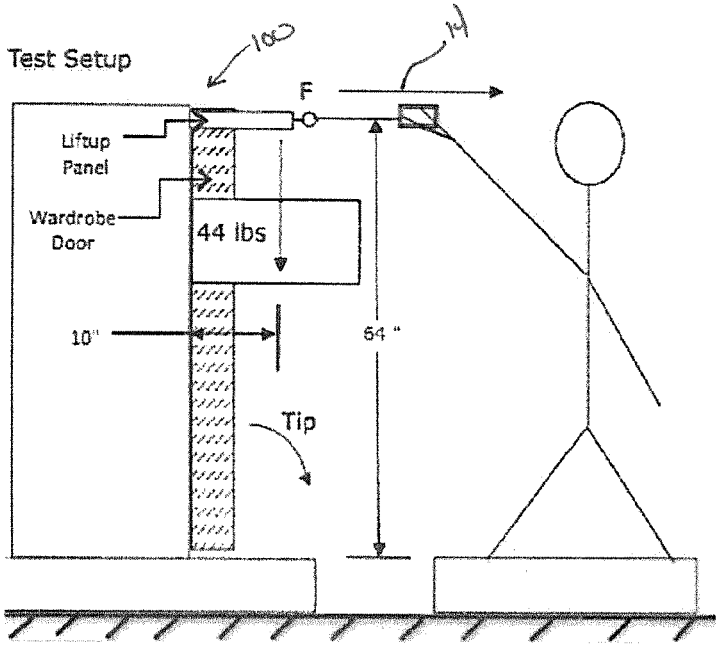
FIG. 5 is a schematic view of a test set up for a prior art file cabinet without the roller.

Experimental Results:

Tests 1 and 2: Prior Art Results of a File Cabinet Without the Roller of This Invention:

FIGS. 4 and 5, show a schematic representation of an experiment illustrating danger of prior art file cabinets without the roller of this invention. In this experiment, a file cabinet 100 was tested. The model was a tower-vertical, 4 drawer cabinet with a lift-up drawer and a wardrobe door, measuring 24 inches by 24 inches by 65.5 inches tall, weighing 189 lbs. without a counterweight. Test conditions included: a level, carpeted surface; the wardrobe door open; the lift-up drawer open and fully extended; the top drawer open and empty; the remaining drawers closed and empty; and a calibrated dynamometer. A tipping force 14 was applied to the cabinet 100 at 64 inches off the ground. FIG. 4 shows the experiment with an empty drawer extended, the following test data was obtained:

TABLE 1

| Trial No. | Pull Force, to tip |
|---|---|
| 1 | 18.3 lbs. |
| 2 | 18.0 lbs. |

TABLE 1-continued

| Trial No. | Pull Force, to tip |
|---|---|
| 3 | 19.5 lbs. |
| 4 | 18.5 lbs. |
| 5 | 18.9 lbs. |
| 6 | 18.8 lbs. |
| 7 | 18.5 lbs. |
| 8 | 19.1 lbs. |
| 9 | 19.0 lbs. |
| 10 | 18.6 lbs. |

The statistical characterization of the test results provide: an average forward tip resistance of 18.72 lbs.; a standard deviation of 0.432 lbs.; a coefficient of variation of 2.3% and a balance angle of 15.5°.

FIG. 5 shows the experiment with 44 lbs. loaded into the extended drawer an empty drawer extended at ten inches from the housing. The following test data was obtained:

TABLE 2

| Trial No. | Pull Force, to tip |
|---|---|
| 1 | 9.1 lbs. |
| 2 | 9.0 lbs. |
| 3 | 9.2 lbs. |
| 4 | 9.3 lbs. |
| 5 | 9.7 lbs. |
| 6 | 9.5 lbs. |
| 7 | 9.7 lbs. |
| 8 | 9.6 lbs. |
| 9 | 9.7 lbs. |
| 10 | 9.1 lbs. |

The statistical characterization of the test results provide: an average forward tip resistance of 9.39 lbs.; a standard deviation of 0.281 lbs.; a coefficient of variation of 2.99% and a balance angle of 9.0°.

As shown in tests 1 and 2, the file cabinet 100 without the roller of this invention can easily be tipped over with less than 20 lbs. of force.

Figure 6A:
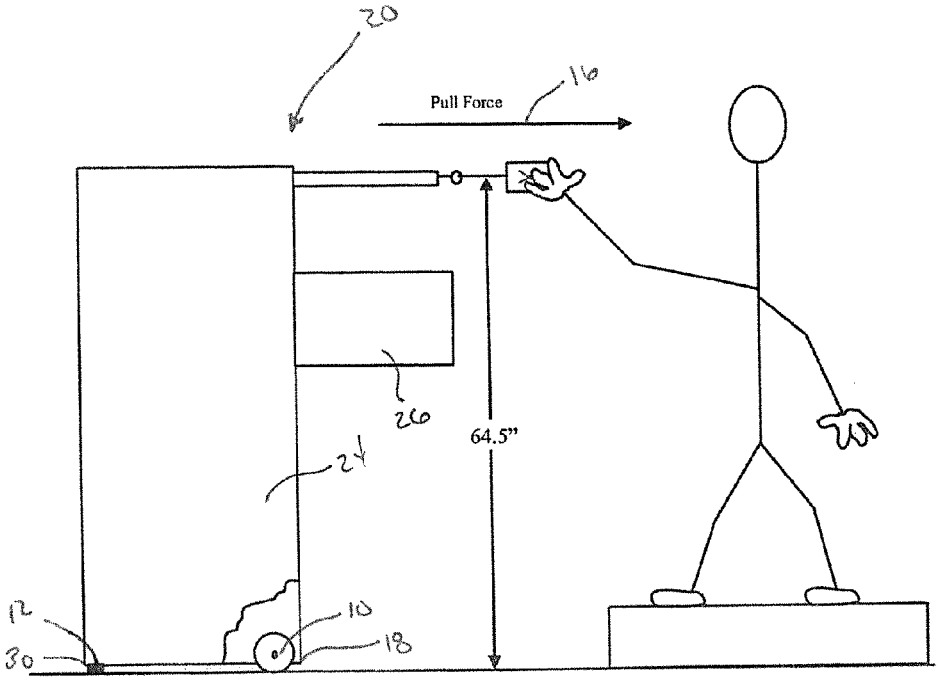
FIG. 6*a* is a schematic view of a test set up for the file cabinet with the roller according to an embodiment of this invention.

Test 3: Empty File Cabinet with the Anti-Tip Roller of this Invention, Protrusion ½ Inch:

FIG. 6*a* show a schematic representation of an experiment illustrating the file cabinet 20 of this invention with the roller 10. In this experiment, the same file cabinet 20 as Tests 1 and 2 was used with the roller 10 retrofit to the cabinet and extending ½ inch from the lower surface. Test conditions included: a level, asphalt tile over concrete surface; the wardrobe door closed; the lift-up drawer open and fully extended; the top drawer open and empty; the remaining drawers closed and empty; and a calibrated dynamometer. A forward acting force 16 was applied to the cabinet 20 at 64.5 inches off the ground. The following test data was obtained:

TABLE 3

| Trial No. | Drag Force |
|---|---|
| 1 | 16.3 lbs. |
| 2 | 14.6 lbs. |
| 3 | 15.6 lbs. |
| 4 | 14.2 lbs. |
| 5 | 14.4 lbs. |
| 6 | 15.1 lbs. |
| 7 | 15.7 lbs. |
| 8 | 17.0 lbs. |
| 9 | 16.6 lbs. |
| 10 | 16.5 lbs. |

In this test, the cabinet 20 of this invention does not tip over and only translates in the direction of the pull force. The statistical characterization of the test results provide: an average drag force of 15.63 lbs.; a standard deviation of 1.030 lbs.; and a coefficient of variation of 6.59%.

Figure 6B:
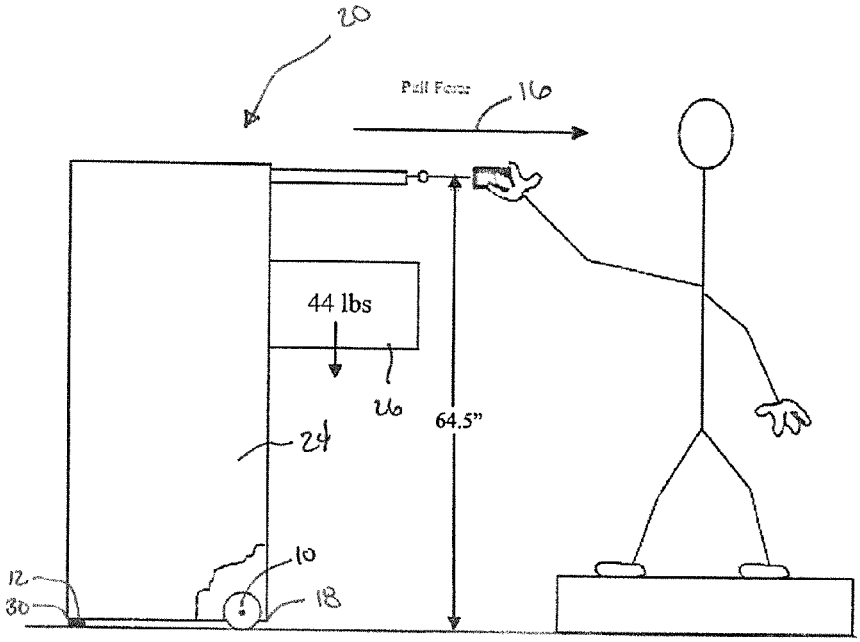
FIG. 6*b* is a schematic view of the test set up for the file cabinet of FIG. 6*a* with 44 lbs. in a drawer.

Test 4: Loaded Cabinet with the Anti-Tip Roller of this Invention, Protrusion ½ Inch:

FIG. 6*b* show a schematic representation of another experiment illustrating the file cabinet 20 of this invention with the roller 10. In this experiment, the same file cabinet 20 as Test 3 was used. This test further includes 44 lbs. in the top drawer and positioned 10 inches from the housing 24. A forward acting force 16 was applied to the cabinet 20 at 64.5 inches off the ground. The following test data was obtained:

TABLE 4

| Trial No. | Drag Force |
|---|---|
| 1 | 16.5 lbs. |
| 2 | 13.4 lbs. |
| 3 | 14.2 lbs. |
| 4 | 14.5 lbs. |
| 5 | 14.7 lbs. |
| 6 | 14.9 lbs. |
| 7 | 14.7 lbs. |
| 8 | 13.4 lbs. |
| 9 | 14.8 lbs. |
| 10 | 14.7 lbs. |

Once again, in this test, the file cabinet 20 of this invention does not tip over and only translates in the direction of the pull force. The statistical characterization of the test results provide: an average drag force of 14.58 lbs.; a standard deviation of 0.870 lbs.; and a coefficient of variation of 5.97%.

Figure 7A:
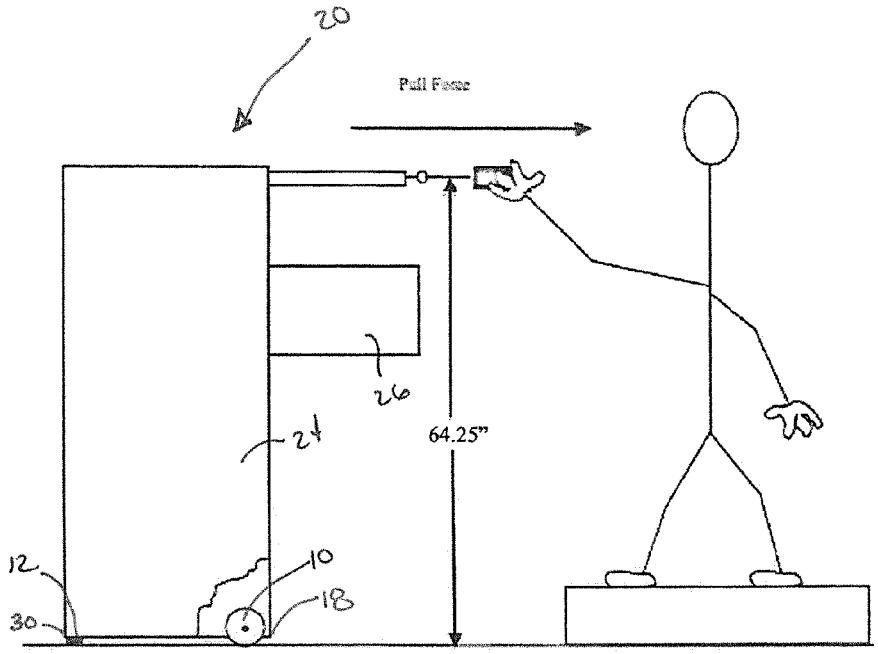
FIG. 7*a* is a schematic view of a test set up for the file cabinet with the roller according to another embodiment of this invention.

Test 5: Empty Cabinet with the Anti-Tip Roller of this Invention, Protrusion ¼ Inch:

FIG. 7*a* show a schematic representation of an experiment illustrating the file cabinet 20 of this invention with the roller 10. In this experiment, the same file cabinet 20 as Tests 1 and 2 was used with the roller 10 retrofit to the cabinet and extending ¼ inch from the lower surface. Test conditions included: a level, asphalt tile over concrete surface; the wardrobe door closed; the lift-up drawer open and fully extended; the top drawer open and empty; the remaining drawers closed and empty; and a calibrated dynamometer. A forward acting force 16 was applied to the cabinet 20 at 64.25 inches off the ground. The following test data was obtained:

TABLE 5

| Trial No. | Drag Force |
|---|---|
| 1 | 18.6 lbs. |
| 2 | 16.8 lbs. |
| 3 | 17.1 lbs. |
| 4 | 18.3 lbs. |
| 5 | 18.8 lbs. |
| 6 | 15.9 lbs. |
| 7 | 15.4 lbs. |
| 8 | 15.4 lbs. |
| 9 | 16.8 lbs. |
| 10 | 15.5 lbs. |

In this test, the file cabinet 20 of this invention does not tip over and only translates in the direction of the pull force. The statistical characterization of the test results provide: an average drag force of 16.86 lbs.; a standard deviation of 1.330 lbs.; and a coefficient of variation of 7.90%.

Figure 7B:
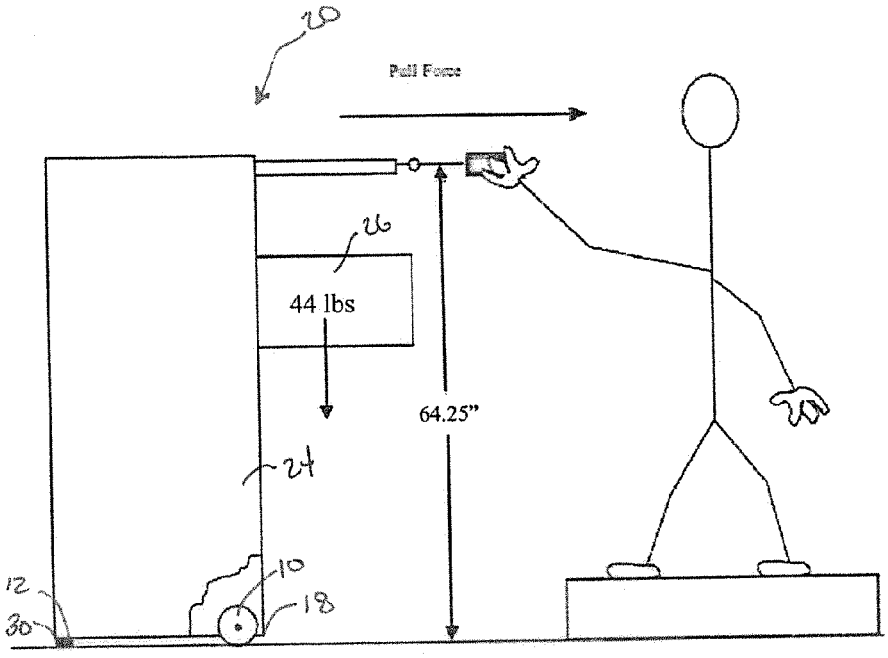
FIG. 7*b* is a schematic view of the test set up for the file cabinet of FIG. 7*a* with 44 lbs. in a drawer.

Test 6: Loaded Cabinet with the Anti-Tip Roller of this Invention, Protrusion ¼ Inch:

FIG. 7*b* show a schematic representation of another experiment illustrating the file cabinet 20 of this invention with the roller 10. In this experiment, the same file cabinet 20 as Test 5. This test further includes 44 lbs. in the top drawer and positioned 10 inches from the housing 24. A forward acting force 16 was applied to the cabinet 20 at 64.25 inches off the ground. The following test data was obtained:

TABLE 6

| Trial No. | Drag Force |
|---|---|
| 1 | 14.9 lbs. |
| 2 | 13.8 lbs. |
| 3 | 14.1 lbs. |
| 4 | 15.2 lbs. |
| 5 | 14.5 lbs. |
| 6 | 14.7 lbs. |
| 7 | 14.2 lbs. |
| 8 | 14.4 lbs. |
| 9 | 13.7 lbs. |
| 10 | 15.2 lbs. |

The experiment showed that the cabinet 20 of this invention does not tip over and only translates in the direction of the pull force. The statistical characterization of the test results provide: an average drag force of 14.47 lbs.; a standard deviation of 0.533 lbs.; and a coefficient of variation of 3.687%.

Thus, the invention of this application provides a file cabinet minimizes or eliminates file cabinets from tipping over and possibly causing injuries.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A tip resistant cabinet comprising:

a tower-vertical file cabinet with a housing including a front edge, a bottom surface, and a plurality of vertically stacked drawers, wherein each of the drawers is horizontally extendable from a front of the housing; and an anti-tip roller connected to the housing, wherein the anti-tip roller is located directly adjacent to, and extending along more than half a length of, the front edge and extending from the bottom surface of the housing, wherein the anti-tip roller is fixed to the housing with a longitudinal axis disposed parallel to the front edge and with one end of the roller directly connected to a side surface of the housing that is perpendicular to the bottom surface, and wherein the anti-tip roller is the only roller projecting from the bottom surface and a rear portion of the bottom surface does not include the anti-tip roller or any second roller, wherein when a forward acting horizontal force extending a top one of the drawers in combination with a downward force from the extended top one of the drawers acting perpendicular to the front edge causes a lower rear edge of the housing to lift off or drag alone a ground, the tip resistant cabinet translates forward on the anti-tip roller without tipping over: and a leveling screw position on the bottom surface of the housing along a rear edge that is opposite the front edge, wherein in a level housing position on a surface, both the anti-tip roller and the leveling screw contact the surface.

2. The tip resistant cabinet of claim 1, wherein the roller partially protrudes through an opening in the bottom surface of the housing, the opening extending along a portion of the front edge from a front corner at one end of the front edge of the housing, wherein the portion of the front edge is more than the half the length of the front edge and less than an entirety of the length.

3. The tip resistant cabinet of claim 2, wherein the roller protrudes from a range of ⅛ inch to 1 inch.

4. The tip resistant cabinet of claim 1, wherein the roller only rolls in one direction.

5. The tip resistant cabinet of claim 1, having only a single roller mounted to the housing and the single roller extending only partially across the bottom surface along the front edge, wherein the anti-tip roller is the single roller.

6. The tip resistant cabinet of claim 1, having only a single roller mounted to the housing and the single roller extending along more than half a length of the front edge of the bottom surface, wherein the anti-tip roller is the single roller.

7. The tip resistant cabinet of claim 1, wherein the roller is located between the front edge and the bottom surface of the housing.

8. The tip resistant cabinet of claim 1, wherein one end of the roller is directly connected to a side surface of the housing that is perpendicular to the bottom surface.

9. The tip resistant cabinet of claim 8, wherein the roller is fixed in position on the housing with a longitudinal axis of the roller disposed parallel to the front edge.

10. The tip resistant cabinet of claim 1, wherein the roller has a longitudinal length along the front edge that is larger than a diameter of the roller.

11. The tip resistant cabinet of claim 1, wherein the roller is off-center from a center of the front edge.

12. The tip resistant cabinet of claim 1, wherein a longitudinal center of the roller is offset from a center of the front edge and bottom surface toward a side of the housing.

13. The tip resistant cabinet of claim 1, wherein the tower-vertical file cabinet comprises four vertically stacked drawers.

14. A method of moving the tip resistant cabinet of claim 1 comprising:

tilting the tip resistant cabinet onto the roller and moving the tip resistant cabinet on the roller.

15. A tip resistant cabinet comprising:

a tower-vertical file cabinet with a housing including a front edge, a bottom surface, and a plurality of drawers, wherein each of the drawers is horizontally extendable from a front of the housing; and an anti-tip roller connected to the housing and directly adjacent to the front edge, the anti-tip roller projecting from ¼ inch to ½ inch from the bottom surface, wherein the anti-tip roller is fixed to the housing with a longitudinal axis disposed parallel to the front edge and with one end of the roller directly connected to a side surface of the housing that is perpendicular to the bottom surface, and wherein when a forward acting horizontal force extending a top one of the drawers in combination with a downward force from the top one of the drawers acting perpendicular to the drawer extended over the front edge causes a lower rear edge of the housing to lift off or drag along a ground, the tip resistant cabinet translates forward on the anti-tip roller without tipping over; and wherein the anti-tip roller is the only roller projecting from the bottom surface and a rear portion of the bottom surface does not include a second roller.

16. The tip resistant cabinet of claim 15, further including a leveling screw positioned on the bottom surface of the housing in proximity to a rear edge of the housing.

17. A tip resistant file cabinet having a tower-vertical file cabinet housing with a plurality of vertically stacked drawers, wherein each of the drawers is horizontally extendable from a front of the housing; and the housing having a single rolling device connected at one end directly to a side surface of the housing that is perpendicular to a bottom surface of the housing, the single rolling device consisting of a single anti-tip roller, wherein the single anti-tip roller extends adjacent and along more than half a length of a front edge of the housing, is fixed to the housing with a longitudinal axis disposed parallel to the front edge, and extends downward beyond the bottom surface of the housing, and when a forward acting horizontal force extending a top one of the drawers in combination with a downward force from the extended top one of the drawers acting perpendicular to the front edge causes a lower rear edge of the housing to lift off or drag along a ground, the tip resistant file cabinet translates forward on the roller without tipping over.

18. The tip resistant file cabinet of claim 17, wherein the downward force comprises the top one of the drawers being overloaded and extended beyond the front of the housing, and when the lower rear edge of the housing lifts off or drags along the ground the tip resistant file cabinet rotates about an axis of the anti-tip roller to translate forward on the anti-tip roller without tipping over.

19. The tip resistant file cabinet of claim 17, wherein the anti-tip roller has a longitudinal length along the front edge that is larger than a diameter of the roller.

* * * * *